US007066783B2

(12) United States Patent
Fischer

(10) Patent No.: US 7,066,783 B2
(45) Date of Patent: Jun. 27, 2006

(54) FIGURE TRANSPORTING TOY

(75) Inventor: Troy Fischer, Brooklyn, NY (US)

(73) Assignee: Marvel Characters, Inc., New York, NY (US)

( * ) Notice: Subject to any disclaimer, the term of this patent is extended or adjusted under 35 U.S.C. 154(b) by 0 days.

(21) Appl. No.: 10/777,550

(22) Filed: Feb. 12, 2004

(65) Prior Publication Data

US 2005/0181704 A1 Aug. 18, 2005

(51) Int. Cl.
*A63H 13/12* (2006.01)
*A63H 3/18* (2006.01)

(52) U.S. Cl. ..... 446/322; 446/138; 446/330; 446/477; 434/393

(58) Field of Classification Search ..... 446/322–324, 446/308, 309, 315, 330, 332, 351, 137–139, 446/167, 236, 901, 3, 83, 97, 476–478; 482/23, 482/24, 35, 33; 434/247, 256, 257, 393, 434/392

See application file for complete search history.

(56) References Cited

U.S. PATENT DOCUMENTS 1,046,329 A * 12/1912 Reach ..... 482/24
1,119,726 A * 12/1914 Rosenberger ..... 482/24
1,126,082 A * 1/1915 Reach ..... 482/23
1,515,146 A * 11/1924 Clark ..... 446/322
1,725,870 A * 8/1929 Kucher ..... 446/322
1,974,531 A * 9/1934 Dahl ..... 482/24
2,445,387 A * 7/1948 Davis ..... 446/322
2,648,158 A * 8/1953 Young ..... 446/138
5,232,392 A 8/1993 Ortiz

* cited by examiner

*Primary Examiner*—Bena Miller
(74) *Attorney, Agent, or Firm*—John M. Johnson, Esq.; Carter Ledyard & Milburn LLP

(57) ABSTRACT

A toy comprising a figure having an arm attachment portion; and at least two figure transport units, each of said figure transport units having a body and an arm movable between a first position and a second position with respect to said body, said arm having a figure attachment portion for removable attachment of said figure thereto, said figure attachment portion of said arm having a first configuration for attachment of said figure to said arm by attachment of said figure attachment portion of said arm to said arm attachment portion of said figure where said arm is in said first position, said figure attachment portion of said arm having a second configuration for removal of said figure from said arm by separation of said figure attachment portion of said arm from said arm attachment portion of said figure when said arm is in said second position whereby said figure is transported from a first one of said at least two figure transport units to a second one of said at least two figure transport units after movement of said arm of said first one of said at least two figure transport units from said first position to said second position.

24 Claims, 12 Drawing Sheets

FIGURE TRANSPORTING TOY

BACKGROUND OF THE INVENTION

The invention relates to toys having multiple separate moving components, and more specifically to such toys wherein a figure can be transported between these multiple moving components.

U.S. Pat. No. 2,648,158 discloses a magnetic toy trapeze having a framework for supporting a plurality of trapezes and one or more figures. Magnets are located in the trapeze bars, and a magnetically conductive material is located in the figure for magnetic attachment of the figure to the trapeze bars. Magnets of variable strengths are located in the different trapeze bars for movement of the figure from one trapeze bar to another.

U.S. Pat. No. 523,392 teaches a toy trapeze assembly that includes a frame structure with support means thereon to maintain the structure in a stable, generally elevated, horizontal position. Further included in the assembly, are two horizontal trapeze bars. The trapeze bars are attached at opposite distal ends thereof to a pair of rigid swing supports. The rigid swing supports are removably secured at one of a plurality of spaced apart positions along the frame structure, and are structured and disposed such that the bars will swing in a generally pendulum like, horizontally oriented manner. Included on one of the trapeze bars are launching means. The launching means are structured such that a trapeze acrobat figure, releasably attached thereto, may be launched therefrom and towards the second trapeze bar, when the rigid swing supports engage a generally U-shaped stopper frame. Included on the second trapeze bar are catching means upon which the launched acrobat may be attached, or a catcher trapeze acrobat may be attached, employing hook-and-loop fasteners to catch the first acrobat.

None of the prior art teaches or suggests the automatic release of the figure from the moving portion of the structure by a change in the physical configuration of the moving portion of the structure when the moving portion of the structure has moved from a first position to a second position.

SUMMARY OF THE INVENTION

A figure transporting toy comprises a figure having an arm attachment portion and at least two figure transport units. Each of the figure transport units has a body and an arm movable between a first position and a second position with respect to the body. The arm has a figure attachment portion for removable attachment of the figure thereto. The figure attachment portion of the arm has a first configuration for attachment of the figure to the arm by attachment of the figure attachment portion of the arm to the arm attachment portion of the figure where the arm is in the first position. The figure attachment portion of the arm has a second configuration for removal of the figure from the arm by separation of the figure attachment portion of the arm from the arm attachment portion of the figure when the arm is in the second position. In this manner, the figure is transported from a first figure transport unit to a second figure transport unit after movement of the arm of the first figure transport unit from the first position to the second position.

Preferably, the arms of the figure transport units move between the first position and the second position in arcuate paths. Preferably, at least one of the figure transport units has a spring bias for powering movement of the arm from the first position to the second position. Preferably, the figure is placed on an additional component of the toy, such as, for example, a car after the second figure transport unit moves to the second position for removal of the figure from the figure transport unit. Preferably, one of the arm attachment portion of the figure and the figure attachment portions of the arms of the figure transport units is a magnet and the other is a magnetically conductive material.

BRIEF DESCRIPTION OF THE DRAWINGS

The invention, and its method of operation, together with additional objects and advantages thereof, can be better understood by reference to the following detailed description considered in connection with the accompanying drawings wherein.

DETAILED DESCRIPTION OF THE PREFERRED EMBODIMENTS

Referring to FIGS. 1 through 4, the operation of the figure transporting toy 2 is shown and below described. Figure transporting toy 2 is preferably comprised of a FIG. 4 and a plurality of figure transport units 6, 8 and 10.

Figure 4:
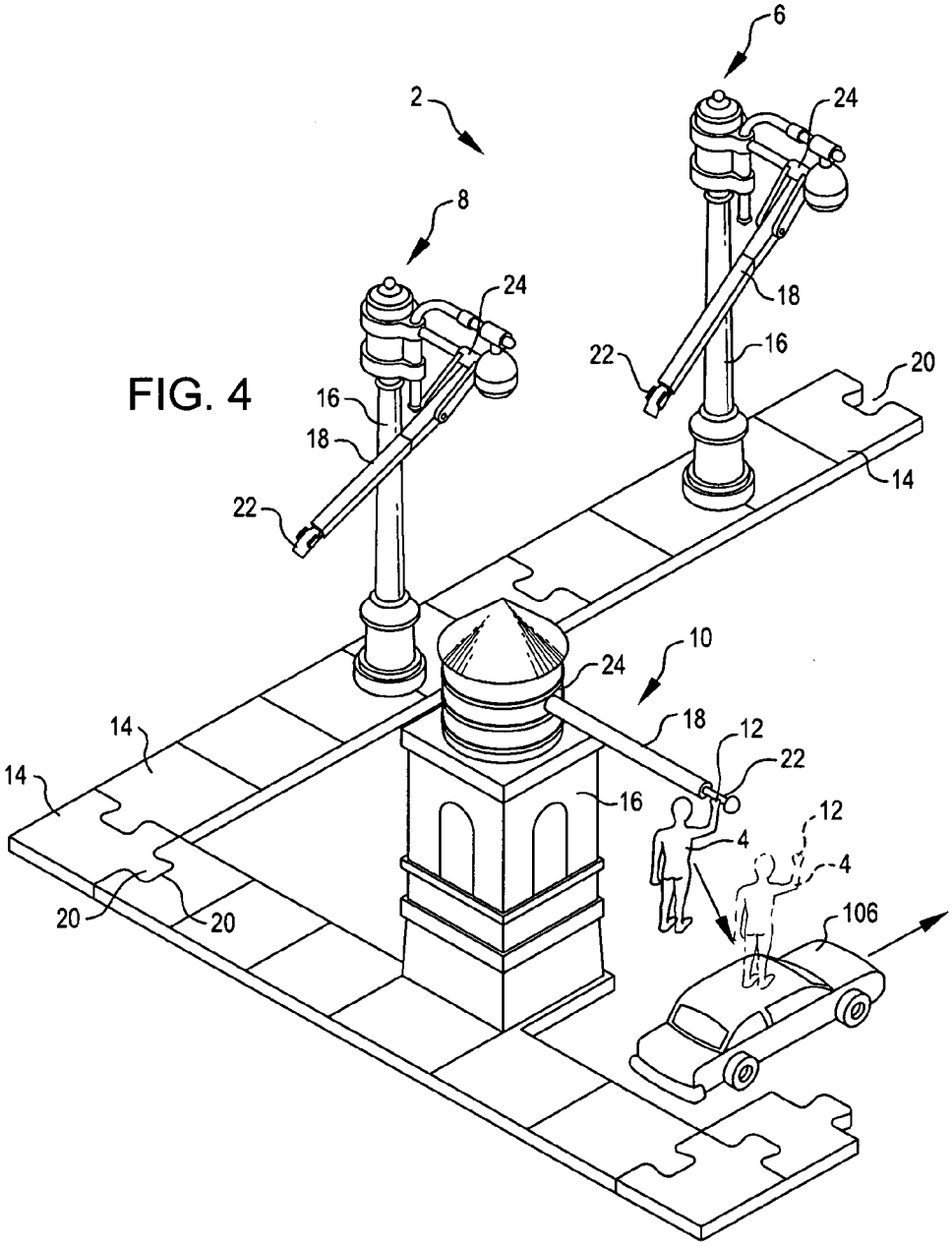
FIG. 4 is a perspective view of the toy of the subject invention showing the figure being transferred from the third figure transport unit onto a toy vehicle.
Figure 5:
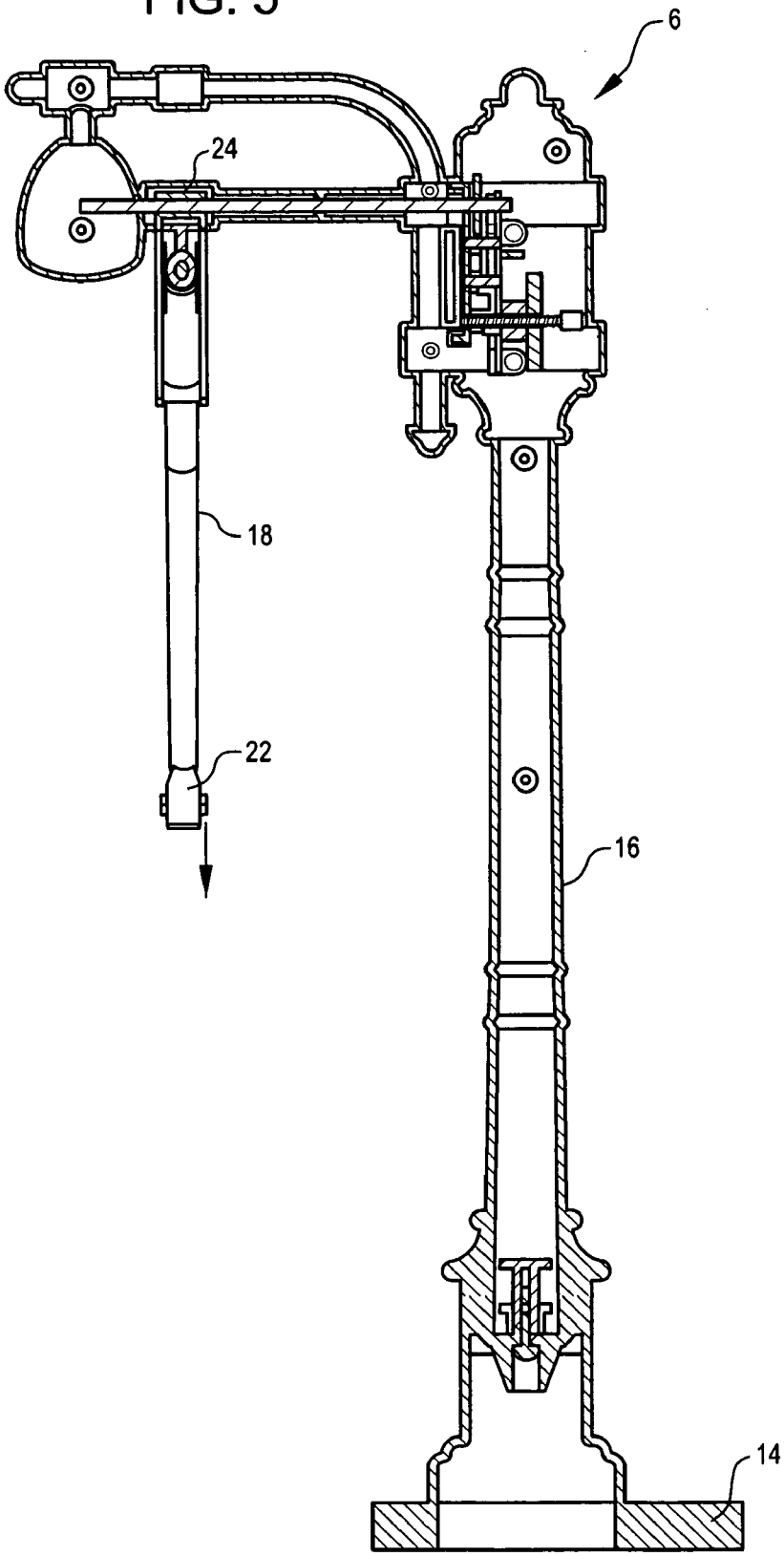
FIG. 5 is an exposed side view of a first embodiment of a figure transport unit of the subject invention.
Figure 6:
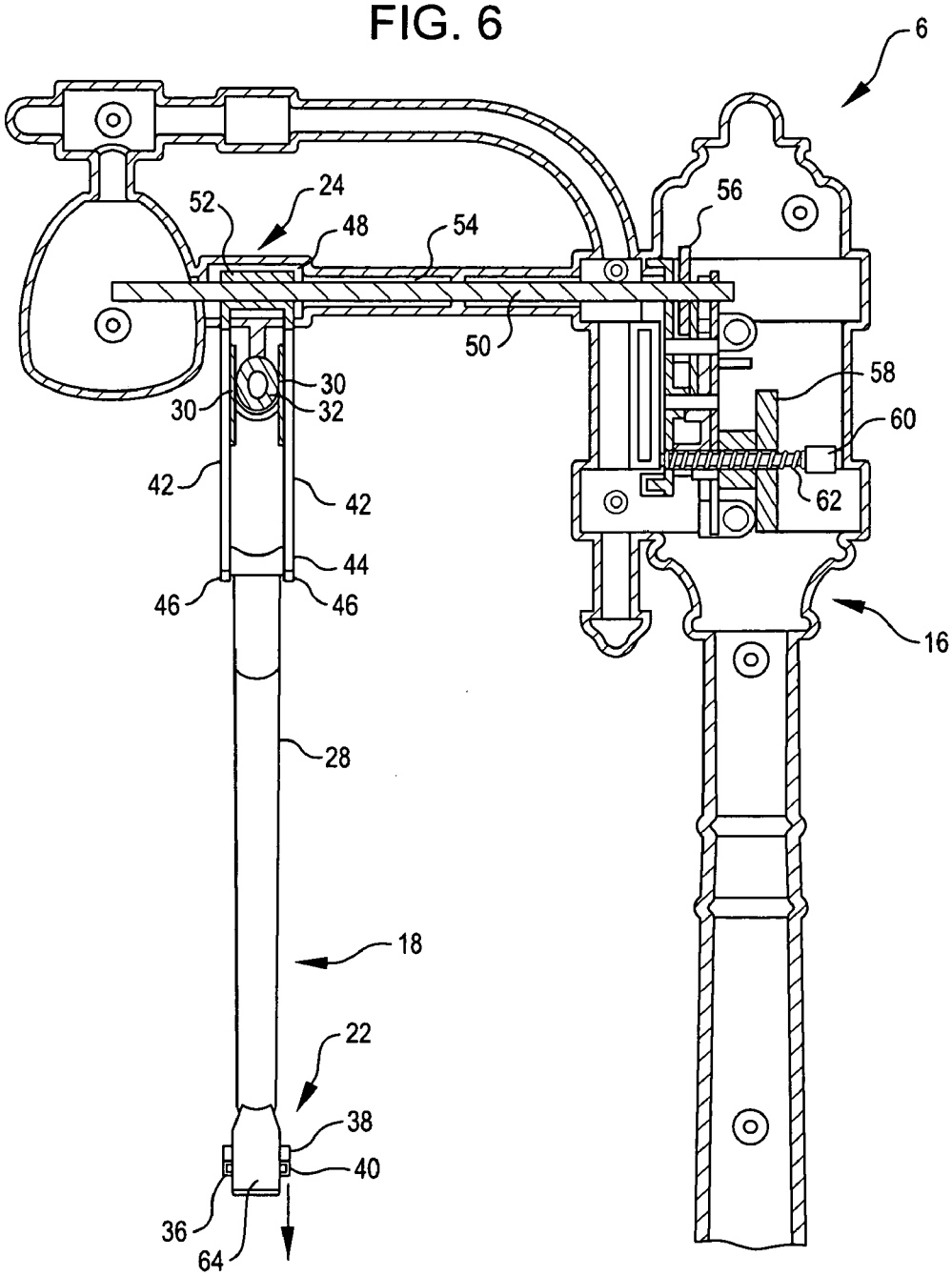
FIG. 6 is an enlarged detail view of FIG. 5.
Figure 7:
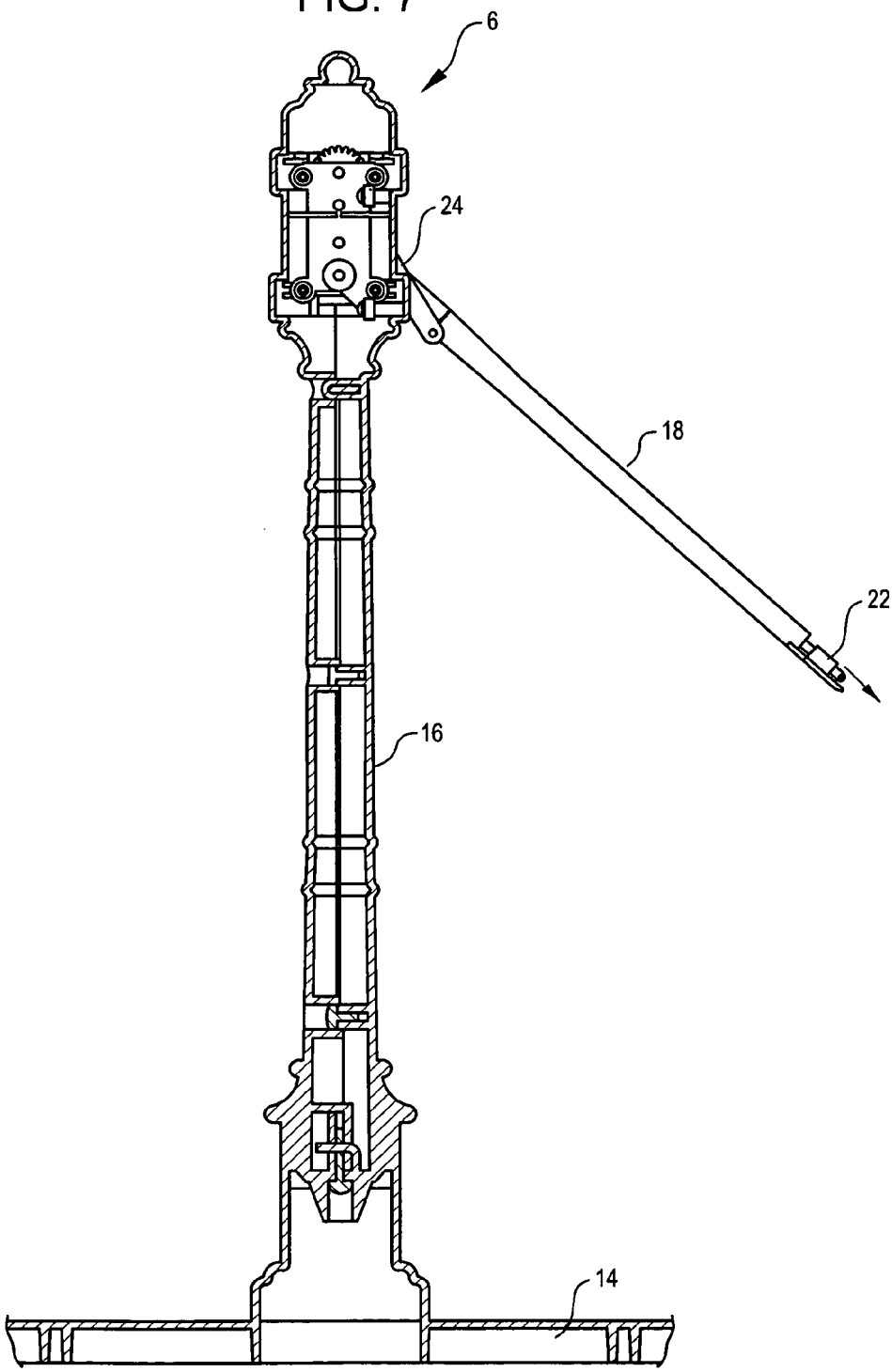
FIG. 7 is another exposed side view taken at 90° from FIG. 5 of a first embodiment of a figure transport unit of the subject invention.
Figure 8:
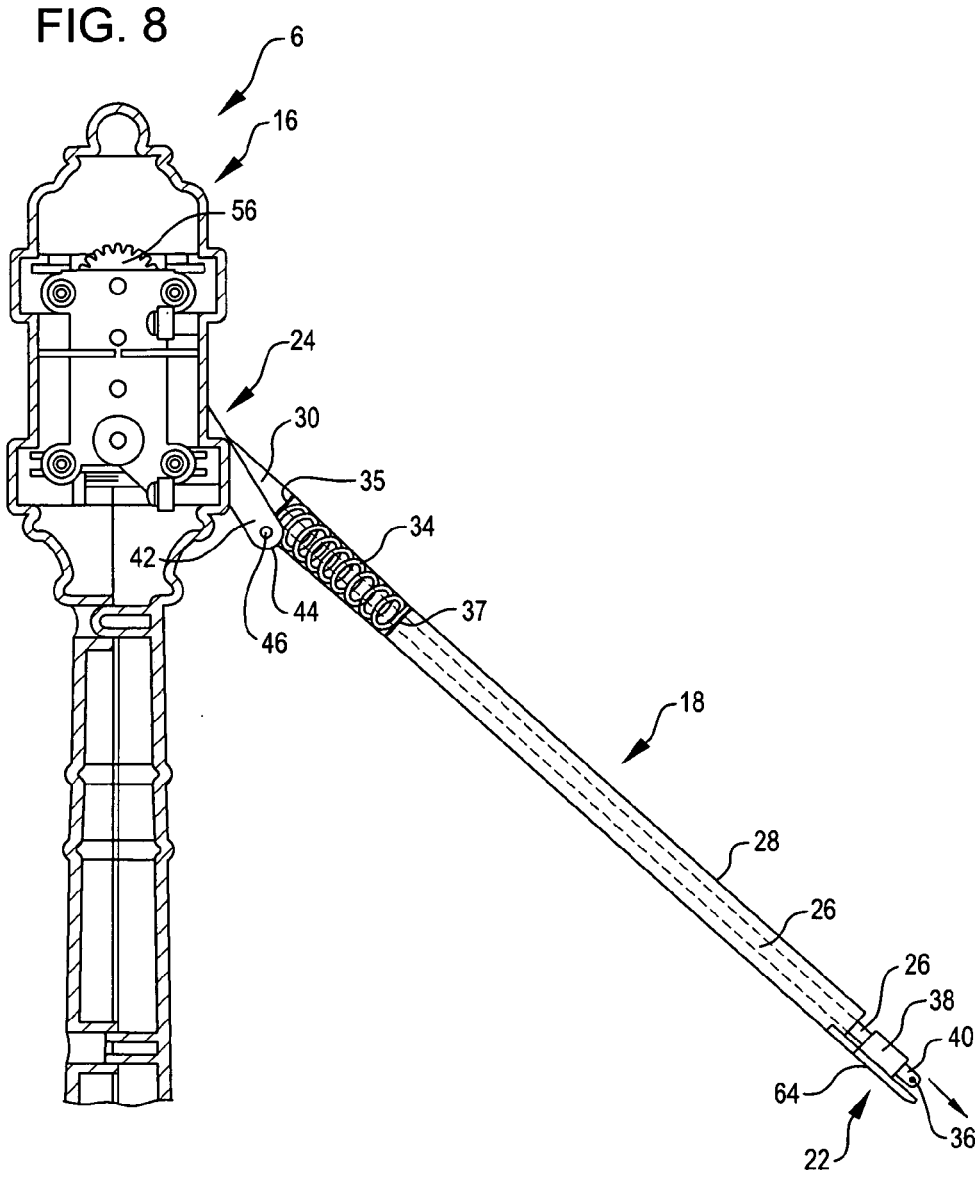
FIG. 8 is an enlarged detail view of FIG. 7.
Figure 9:
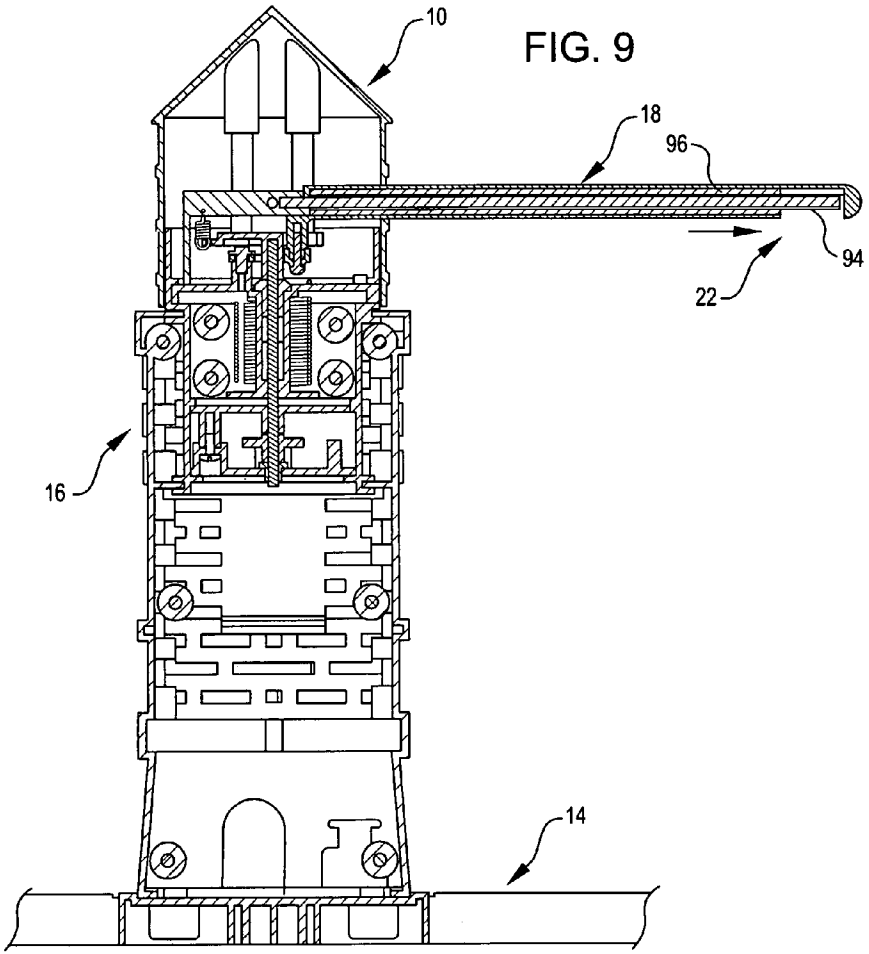
FIG. 9 is an exposed side view of a second embodiment of a figure transport unit of the subject invention.

While FIG. 4 herein is shown in human form, it is to be understood that FIG. 4 can be of any shape and design, including by non-limiting example, human, animal, superhero, "alien", or any inanimate object, as long as FIG. 4 is sized and shaped to function with figure transport units 6, 8 and 10. Disposed on one ore more of the limbs of FIG. 4 is one or more arm attachment portion 12, employed to removably attach FIG. 4 to the arms of figure transport units 6, 8 and 10 as described in further detail below. Arm attachment portion 12 is preferably one of a magnet and a magnetically conductive material, such as, for example, an iron containing alloy. When this configuration of arm attachment portion 12 is employed, figure attachment portions of the arms of figure transport units 6, 8 and 10 are the other of a magnet and a magnetically conductive material. In the embodiment specifically described herein, arm attachment portion 12 is a magnet and the figure attachment portions of the arms of the figure transport units 6, 8 and 10 are comprised of a magnetically conductive material. Alternatively, arm attachment portion 12 of FIG. 4 and the figure attachment portions of arms of figure transport units 6, 8 and 10 can both be magnets or can both be complementary hook and loop fasteners.

Figure transport units 6, 8 and 10 each preferably include a base 14, a body 16 and an arm 18. Base 14 preferably includes a mating portion 20, complementary with the mating portion 20 of another base 14 such that figure transport units 6, 8 and 10 (and others) can be deployed in a virtually infinite number of configurations to provide a virtually infinite number of transport paths for FIG. 4, thus increasing the enjoyment of figure transporting toy 2 to the user. In the embodiment shown in FIGS. 1 through 4, by non-limiting example, mating portions 20 on neighboring bases 14 are either complementary "jig saw" type male extensions or female indentations.

Body 16 of figure transport units 6, 8 and 10 contain the mechanical elements for movement of arm 18, are located on bases 14, and are sized and shaped to suspend arms 18 a predetermined, desired distance above bases 14 such that FIG. 4 can be transported by movement of arms 18 without contacting bases 14 in an entertaining above-ground manner.

Each arm 18 of figure transport units 6, 8 and 10 is an elongate member attached to body 16 at one of its ends at pivot point 24, and has, on its opposite end, figure attachment portion 22 remotely located from body 16. Arm 18 moves with respect to body 16 of figure transport units 6, 8 and 10 in a manner further described below, and preferable describes an arcuate segment around pivot point 24.

Next referring to FIGS. 5 through 8, a first embodiment of the figure transport unit of the present invention is shown and discussed below, as exemplified by figure transport units 6 and 8. Figure transport units 6 and 8 have a body 16 supported by a base 14, and have an arm 18 movably attached thereto at pivot point 24, as previously described above. Arm 18 includes interior rod 26 sheathed by exterior tube 28. Interior rod 26 is longitudinally reciprocatable with respect to exterior tube 28 as further described below. Interior rod 26 is pivotally secured to body 16 by attachment of two interior rod flanges 30 on each side of body flange 32 with the passage of a securing pin through the aligned central openings of interior rod flanges 30 and body flange 32. Interior rod 26 pivots with respect to body 16 around pivot point 24 and the outer end thereof is longitudinally extendable and retractable with respect to the outer end of exterior tube 28. Spring 34 is located over interior rod 26 within exterior tube 28 and abuts both end 35 of interior rod flanges 30 and inner shoulder 37 within exterior tube 28 to be fixedly located therebetween. Spring 34 provides a spring bias for reciprocation of interior rod 26 (which is sized to be slightly longer than exterior tube 28) within exterior tube 28 and for retraction of the outer end of interior rod 26 with respect to the outer end of exterior tube 28 as arm 18 moves in an arc around body 16. This spring bias by spring 28 facilitates both pivoting movement of arm 18 and retraction of the outer end of interior rod 26 with respect to the outer end of exterior tube 28.

Interior rod 26, on its outer end, the end opposite from the end having interior rod flanges 26, has thereon figure attachment portion 22. Figure attachment portion 22, in this exemplary, non-limiting embodiment, is comprised of figure attachment shaft 36, made of a magnetically conductive iron containing alloy in this embodiment, rotatably secured (around its longitudinal axis) to the end of interior rod 26 between flanges 40 of support 38.

Exterior tube 28 is sized and shaped to receive interior rod 26 which is slightly longer. Exterior tube 28 is pivotally attached to body 16 by two supports 42 at location 44. At location 44, substantially remote from pivot point 24, pin 46 pivotally secures supports 42 to exterior tube 28 such that relative longitudinal movement between exterior tube 28 and interior rod 26 (which is, instead, only secured to body 16 by attachment of interior rod flanges 30 to body flange 32 substantially at pivot point 24) is facilitated as arm 18 traverses its arcuate path. At location 48, exterior tube 28 is fixedly secured to shaft 50 within body 16 by passage of collar 52 of supports 42 over shaft 50 such that supports 42 rotate as shaft 50 rotates, as described in further detail below. Shaft 50 is located in conduit 54 of body 16, and its end remote from collar 52 of supports 42 is secured to step gears 56. Step gears 56 are meshed with counter weight 58. Counter weight 58 includes an axel 60 with spring 62 fixedly secured around axel 60. Counter weight 58 and spring 62 provide resistance against spring 34 of interior rod 26 of arm 18 as interior rod 26 retracts from its extended position, as described in further detail below, in order to control the rate of travel of arm 18.

Exterior tube 28 has, on its end remote from supports 42 and adjacent figure attachment shaft 36 of interior rod 26, attachment shield 64. Attachment shield 64 is sized, shaped and located on exterior tube 28 such that figure attachment shaft 36 is covered by attachment shield 64 when the outer end of interior rod 26 is in its retracted position whereby figure attachment shaft 36 is prevented from magnetically attaching FIG. 4 at its arm attachment portion 12, and such that figure attachment shaft 36 is extended away from figure attachment shield 64 when the outer end of interior rod 26 is in its extended position with respect to exterior tube 28 whereby figure attachment shaft 36 can magnetically attach FIG. 4 at its arm attachment portion 12.

Figure 1:
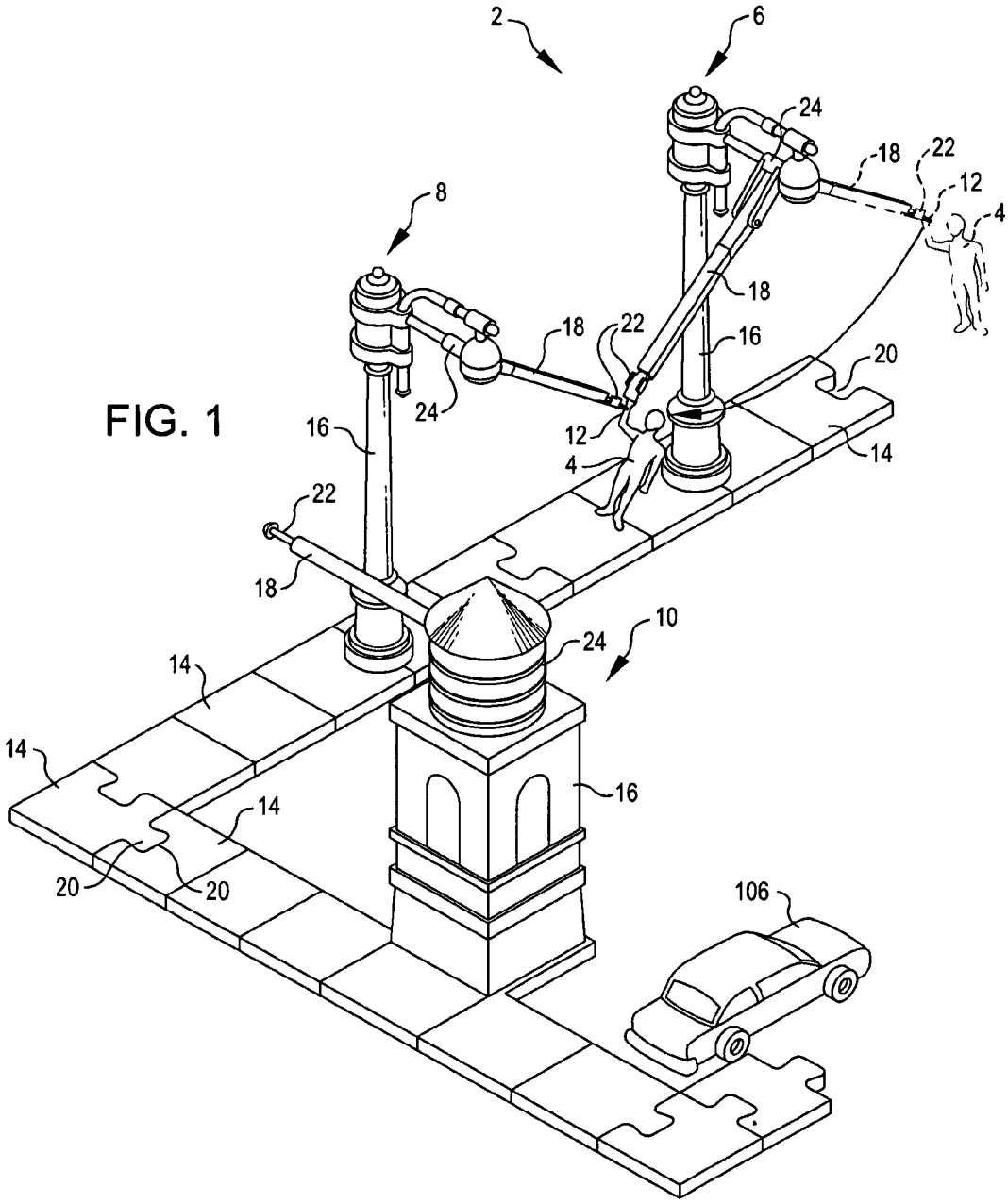
FIG. 1 is a perspective view of the toy of the subject invention showing a figure being transported on a first figure transport unit.

Referring again to FIGS. 1 and 2, and in conjunction with FIGS. 5 through 8, the operation of figure transport units 6 and 8 is described. As shown in the phantom-lined portion of FIG. 1, FIG. 4 is magnetically attached at its arm attachment portion 12 to figure attachment portion 22 of arm 18 of figure transport unit 6. More specifically, arm 18 is oriented in a first configuration in which interior rod 26 is extended with respect to exterior tube 28 of arm 18 such that figure attachment shaft 36 can magnetically attach FIG. 4 at its arm attachment portion 12. FIG. 4 can be initially so attached to arm 18 by placement of FIG. 4 on arm 18 by the user to start the toy, or by prior travel of FIG. 4 from another figure transport unit similar to figure transport unit 6, 8 or 10. Next, the weight (mass) of FIG. 4, merely by being placed on arm 18 of FIG. transport unit 6 causes arm 18 to begin to travel from its first configuration (the beginning of the, for example, about 20° to 80° arcuate path that arm 18 traverses) towards is final, second configuration (the end of the aforesaid arcuate path). As the above arcuate path is traveled between its beginning and its end, the spring bias of spring 34 facilitates both the retraction of the outer end of interior rod 26 with respect to the outer end of exterior tube 28 as well as the continued movement of arm 18 through its arcuate path as the force released by spring 34 is transferred to pivot point 24 through interior rod flanges 30 and body flange 34 thereby causing likewise pivoting movement of supports 42 and rotation of shaft 50 fixed thereto. As stated above, step gears 56, counter weight 58, axel 60 and spring 62 provide resistance of a predetermined amount to control as desired the rate of travel of arm 18 due to their attachment to rotation shaft 50. Further regarding the retraction of the outer end of interior rod 26, figure transport unit 6 is configured such that retraction of the outer end of interior rod 26 with respect to the outer end of exterior tube 28 will occur at or near the end of the arcuate path that arm 18 traverses, shown in solid lines in FIG. 1. At this juncture, the retraction of the outer end of interior rod 26 causes figure attachment shaft 36 to become covered by attachment shield 64 of exterior tube 28 whereby figure attachment shaft 36 is prevented from maintaining magnetic attachment with arm attachment portion 12 of FIG. 4. At this nexus, as best shown in FIGS. 1 and 2, FIG. 4 is sloughed off of arm 18 of figure transport unit 6 and is received by arm 18 of figure transport unit 8, which is oriented in its initial, first configuration identical to the initial, first configuration that figure transport unit 6 previously adopted.

Figure 2:
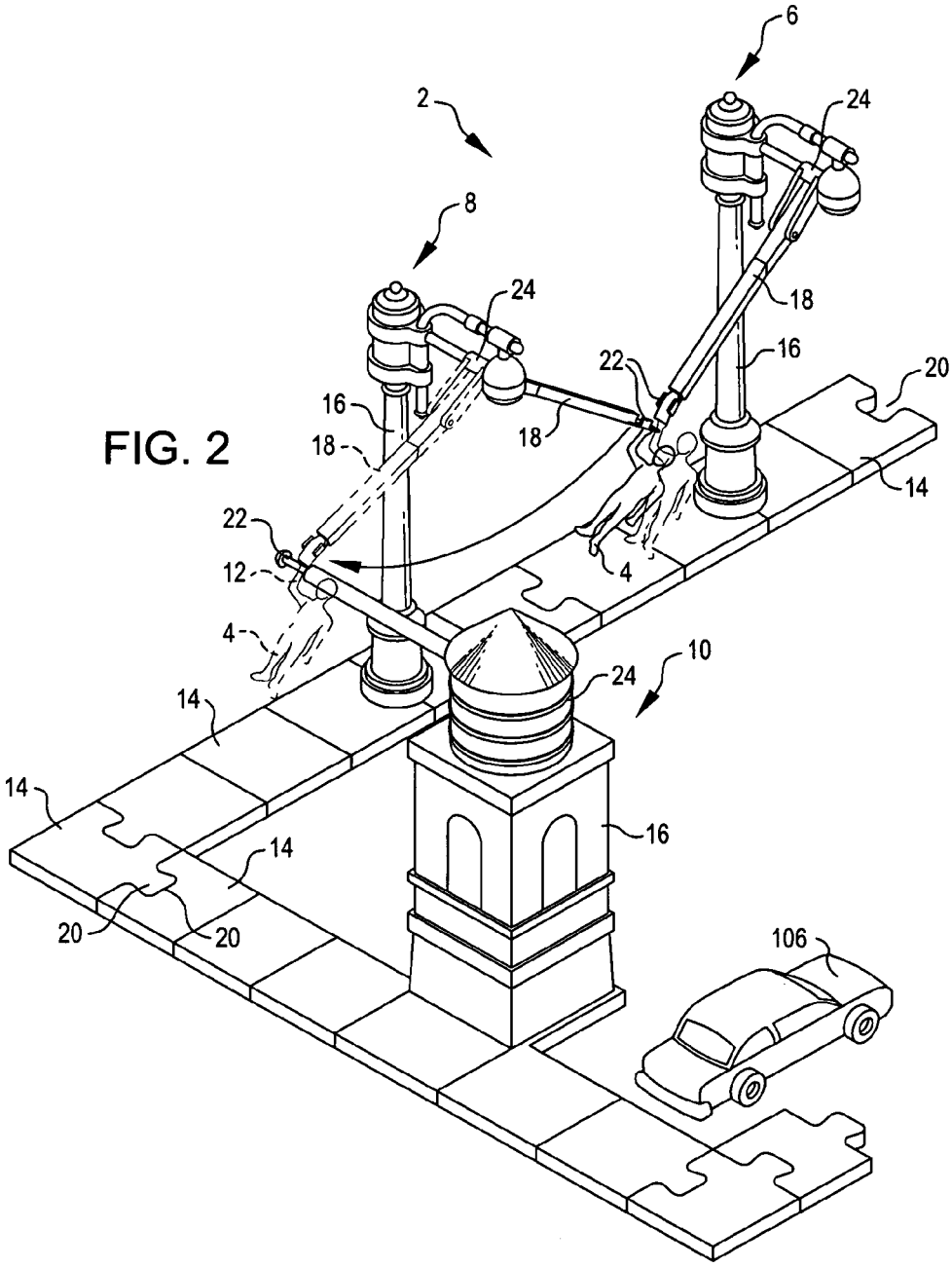
FIG. 2 is a perspective view of the toy of the subject invention showing the figure being transported from the first figure transport unit to a second figure transport unit, and being transported on the second figure transport unit.
Figure 3:
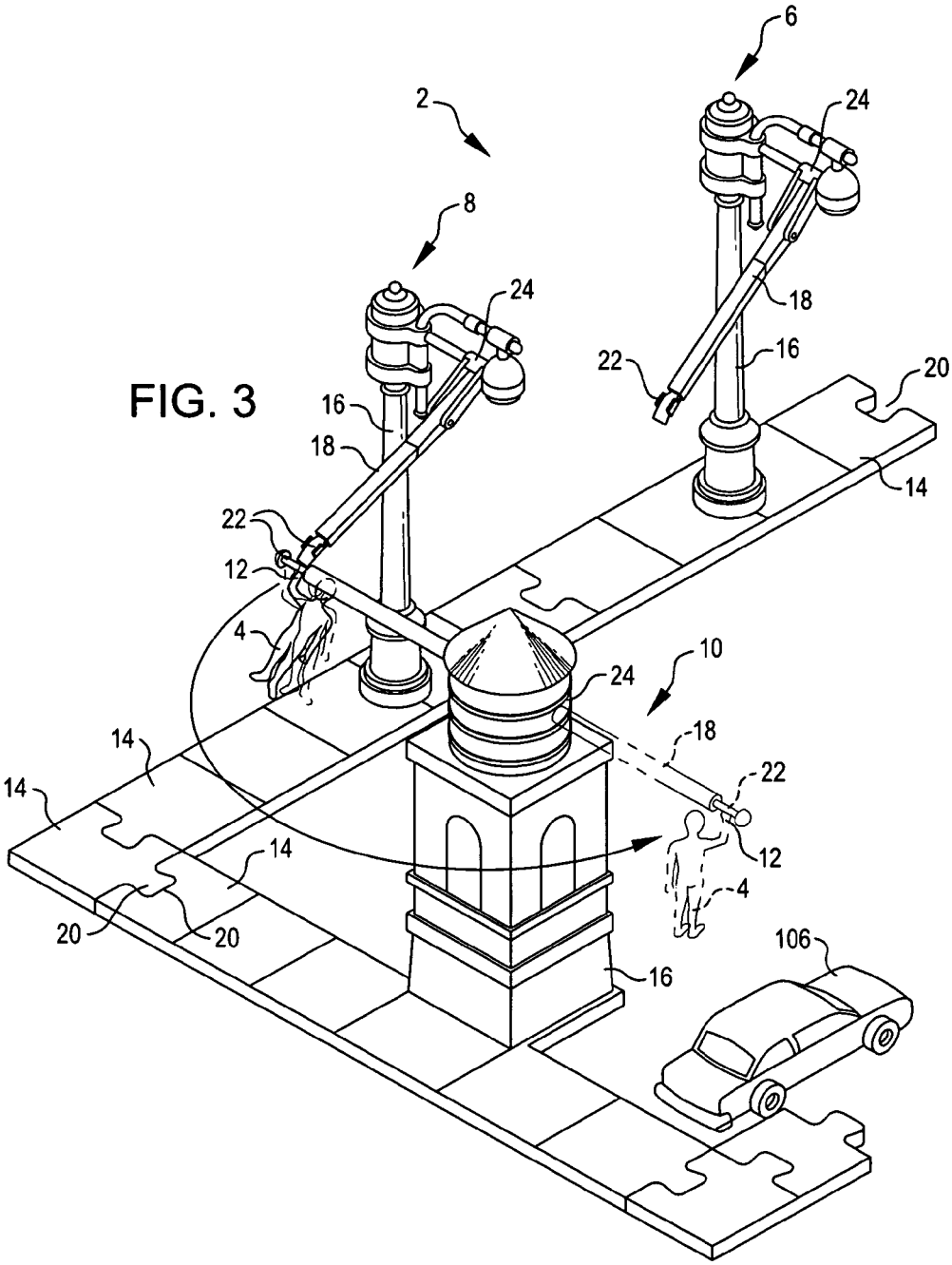
FIG. 3 is a perspective view of the toy of the subject invention showing the figure being transferred from the second figure transport unit to a third figure transport unit, and being transported on the third figure transport unit.

As best shown in FIG. 2, the travel of arm 18 of figure transport unit 8 is shown in both phantom and solid lines from its initial, first configuration to its final, second configuration, both of which are identical to those configurations of figure transport unit 6 as are the related component orientations and movements, which are incorporated herein.

Figure 10:
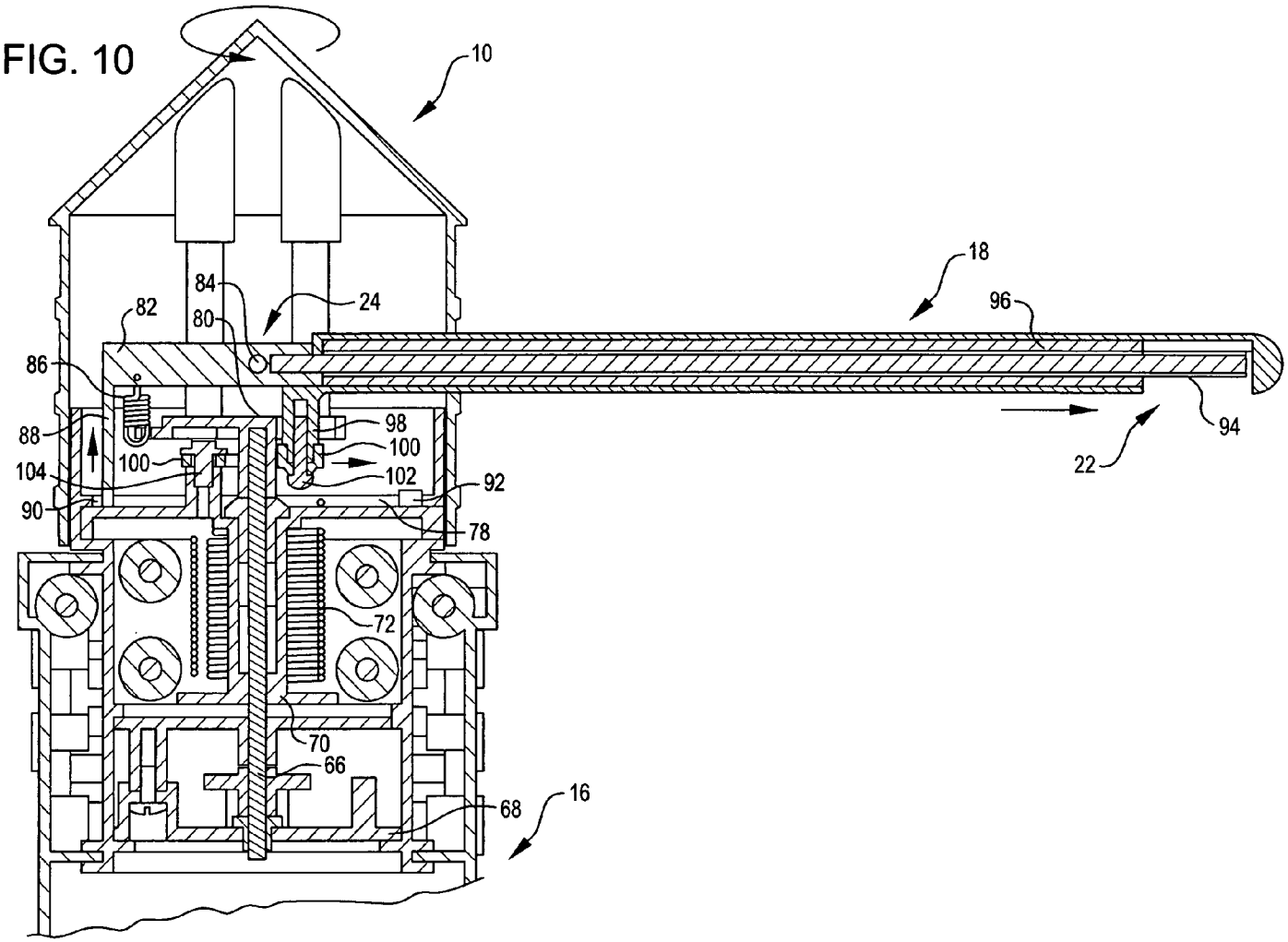
FIG. 10 is an enlarged detail view of FIG. 9.
Figure 11:
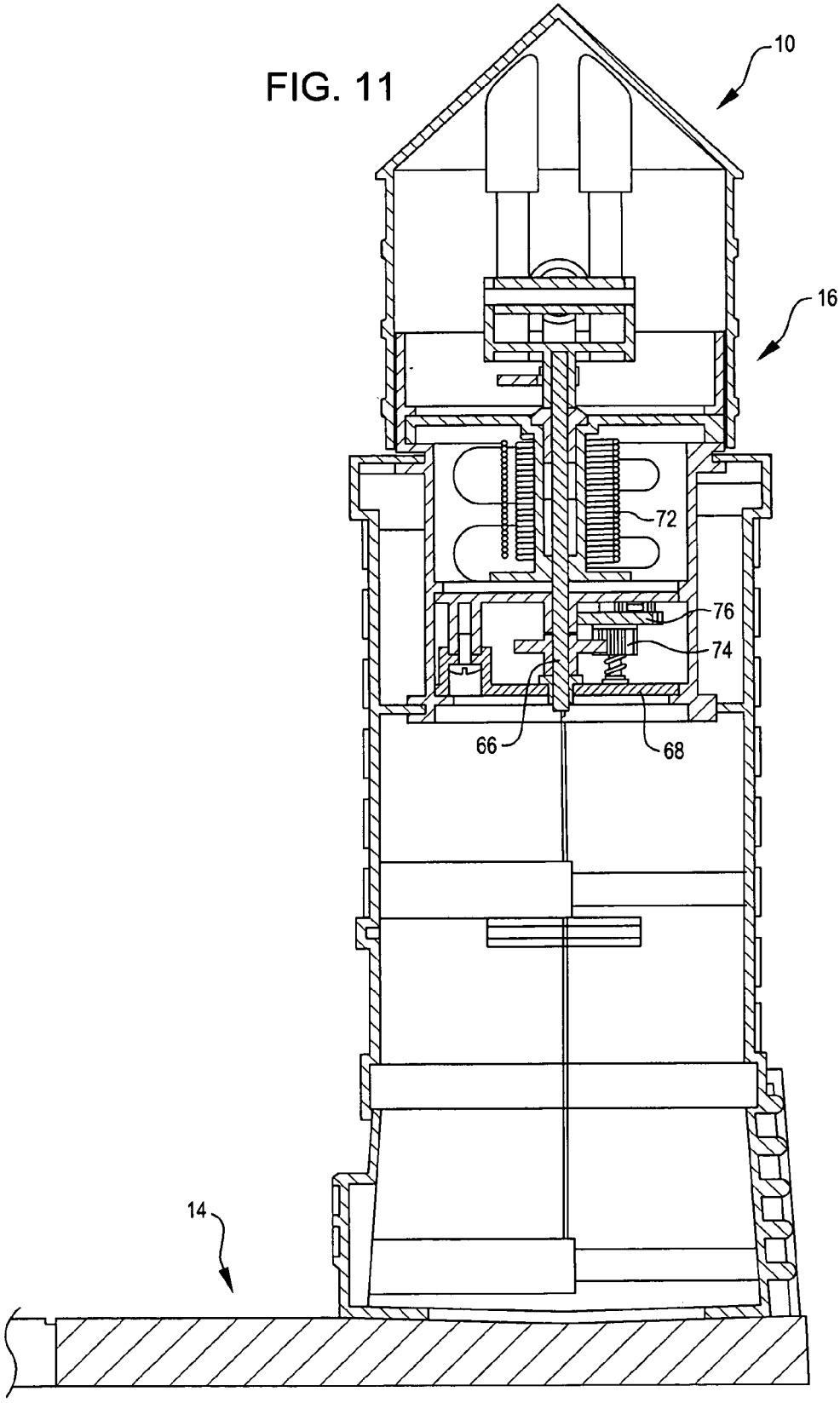
FIG. 11 is another exposed side view taken at 90° from FIG. 9 of a second embodiment of a figure transport unit of the subject invention.
Figure 12:
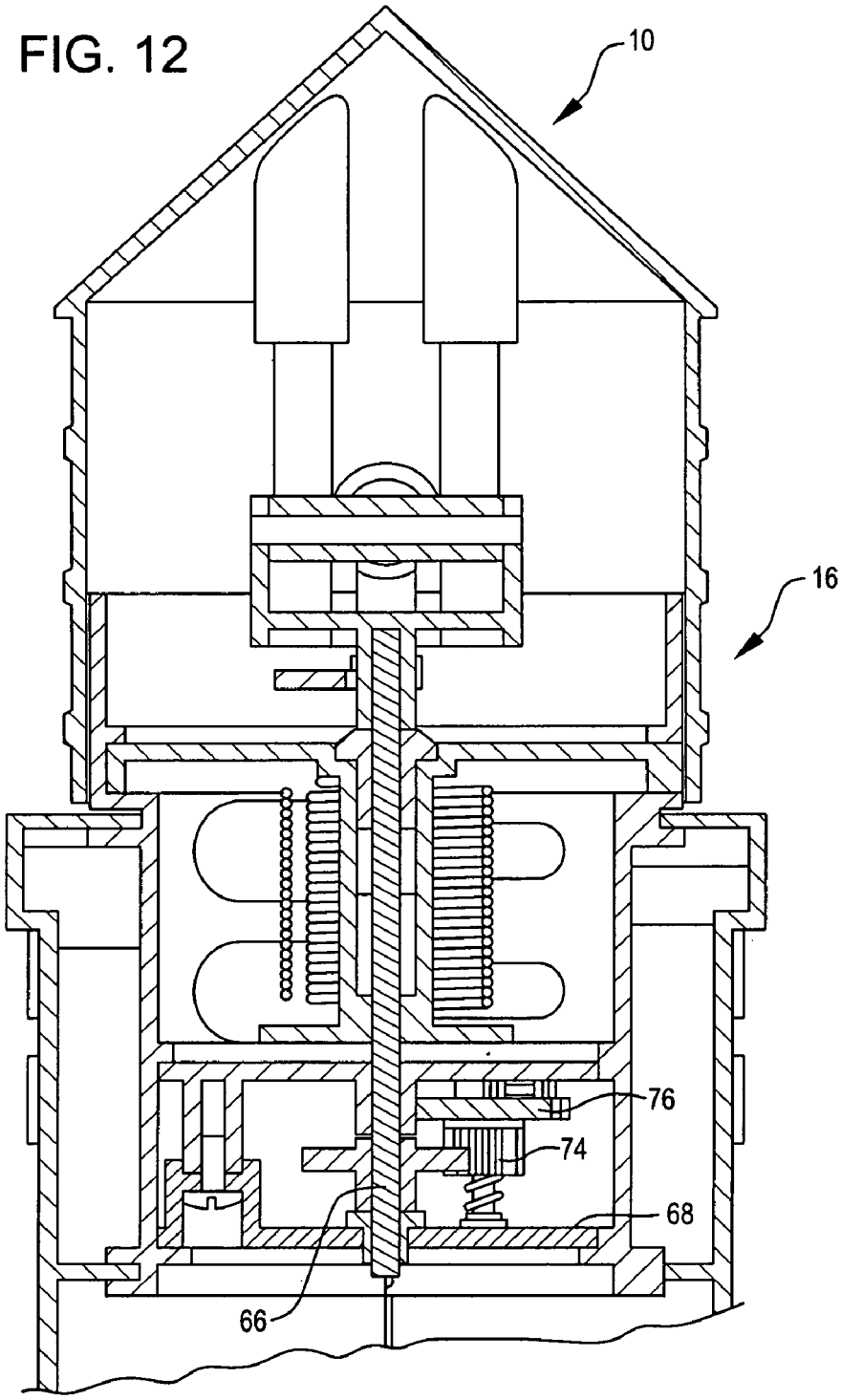
FIG. 12 is an enlarged detail view of FIG. 11.

Prior to describing the transfer of FIG. 4 from figure transport unit 8 of figure transport unit 10, a second embodiment of the figure transport unit of the present invention, figure transport unit 10 will be described in further detail. Referring specifically to FIGS. 9 through 12, figure transport unit 10, has axel 66 rotatably supported in frame 68 of body 16. Hub 70 is fixedly attached to rotatable axel 66 and has spring 72 attached thereto such that the tightening of spring 72 around hub 70 as axel 66 is rotated in one direction "energizes" figure transport unit 10 for operation. Step-up gears 74 and counterweight 76 are interconnected to hub 70 to provide controlled rotation of axel 66. Axel passes through floor 78 of body 16 and is fixedly attached to rotating frame 80. Rotating frame 80 has arm release 82 pivotally attached thereto by means of pivot pin 84. Rotating frame 80 and arm release 82 are also interconnected by trigger spring 86. Trigger spring 86 exerts a bias at pivot pin 84 such that trigger 88, located on the end of arm release 82 remote from the fixed attachment of interior rod 94 to arm release 82, is urged toward floor 78 of body 16 and abuts locking lip 90 when figure transport unit 10 is in its spring 72 wound "energized" configuration as shown in FIG. 10. As mentioned above, interior rod 94 is fixedly attached to arm release 82. Interior rod 94, which is axially stationary during any rotational movement of other components of arm 18, is located within exterior tube 96, which is axially extendable with respect to interior rod 94. More specifically, while interior rod 94 is fixedly attached to arm release 82, exterior tube 96 is not attached to arm release 82, but is instead attached by tube attachment 98 to one end of C-lever 100 (a "C"-shaped arm) and secured with screw 102. The other end of C-lever 100 is pivotally secured by pivot pin 104 to floor 78 of base 14. Floor 78 also has thereon stop 92, in radial alignment with trigger 88 and located preferably about 180° from locking lip 90 on floor 78, and having a greater height than locking lip 90.

Referring again to FIGS. 2 through 4, and in conjunction with FIGS. 9 through 12, the operation of figure transport unit 10 is described. As shown in the phantom-lined portion of FIG. 2, FIG. 4 is being transferred from arm 18 of figure transport unit 8, at its second, final configuration after it has traversed its complete arcuate path, to arm 18 of figure transport unit 10. As stated above, the retraction of interior rod 26 of figure transport unit 6 causes figure attachment shaft 36 to become covered by attachment shield 64 whereby figure attachment shaft 36 is prevented from maintaining attachment with arm attachment portion 12 of FIG. 4. At this nexus, as shown in FIG. 2, FIG. 4 is sloughed off of arm 18 of figure transport unit 8 and is received by arm 18 of FIG. transport unit 10. Figure transport unit 10 is initially oriented in its "energized" initial, first configuration shown in FIGS. 9 through 12 in which it is adapted to receive FIG. 4. More specifically, interior rod 94, (which is, in the present embodiment, figure attachment portion 22 and is comprised of a magnetically conductive material), is unsheathed from exterior tube 96, and arm attachment portion 12 of FIG. 4 thus becomes magnetically attached thereto. The mass (weight) of FIG. 4 on interior rod 94 causes arm 18 to move downward around pivot pin 84 and consequently causes arm release 82 to move upward. This upward motion of arm release 82 also moves trigger 88 upward (against the bias of trigger spring 86), thus disengaging trigger 88 from abutting contact with locking lip 90 on floor such that trigger 88 can pass over locking lip 90. With trigger 88 being freed, wound spring 62 causes axel 60 to rotate. Rotation of axel 60, through its attachment to rotating frame 80, causes rotation of rotating frame 80, arm release 82 and, importantly, arm 18 comprised of interior rod 94 and exterior tube 96. The above rotation continues until trigger 88 contacts stop 92, preferably on the opposite side of floor 78 from locking lip 90; stop 92 having a greater height than that of locking lip 90 over which trigger 88 had passed. As the above described rotation of arm 18 of figure transport unit 10 occurs its orientation is altered from its first, initial configuration to its second, final configuration. More specifically, exterior tube 96 extends to sheath interior rod 94 thus preventing further magnetic attachment between arm attachment portion 12 of FIG. 4 and interior rod 94. As stated above, exterior tube 96 axially extends over interior rod 94 because interior rod 94 is fixedly attached to arm release 82 while, in contrast, exterior tube 96 is not attached to arm release 82 but is instead pivotally attached to floor 78 by means of C-lever 100. Thus, as arm 18 rotates in its arcuate path, C-lever pivots around pivot pin 104 from a first, retracted position to a second, extend position which causes C-lever 100 to push and extend exterior tube 98 outward with respect to fixed inner rod 94 due to the fixed attachment of C-lever 100 to exterior tube 98 at tube attachment 98. In this manner, exterior tube 98 extends over the portion of inner rod 94 to which arm attachment portion 12 of FIG. 4 was magnetically attached, resulting in the removal of FIG. 4 from arm 18 of figure transport unit 10 as best shown in the phantom lines of FIG. 3 and the solid and phantom lines of FIG. 4.

Specifically referring to FIG. 4, FIG. 4 is shown dropping from arm 18 of figure transport unit 10 onto an additional component of figure transporting toy 2, in this example toy car 106. It will be noted however, that this additional component of figure transporting toy 2 can be any type of separate, supplemental or ancillary toy-based component and is not to be limited to a toy car.

It will be apparent to those skilled in the art that a number of changes, modifications, or alterations to the present invention as described herein may be made, none of which depart from the spirit of the present invention. All such changes, modifications, and alterations should therefore be seen as within the scope of the present invention.

I claim:

1. A toy comprising:

a figure having an arm attachment portion; and at least two figure transport units, each of said figure transport units having a body and an arm movable between a first position and a second position with respect to said body, said arm having a figure attachment portion and a figure removal portion for removable attachment of said figure thereto, said figure attachment portion of said arm having a first configuration remote from said figure removal portion for attachment of said figure to said arm by attachment of said figure attachment portion of said arm to said arm attachment portion of said figure when said arm is in said first position, said figure attachment portion of said arm having a second configuration proximate to said figure removal portion for removal of said figure from said arm by separation of said figure attachment portion of said arm from said arm attachment portion of said figure by said figure removal portion when said arm is in said second position whereby said figure is transported from a first one of said at least two figure transport units to a second one of said at least two figure transport units after movement of said arm of said first one of said at least two figure transport units from said first position to said second position.

2. The toy of claim 1 wherein said arms of said at least two figure transport units move between said first position and said second position in an arcuate path.

3. The toy of claim 1 wherein at least one of said at least two figure transport units further comprises a spring bias for powering movement of said arm of said at least one of said at least two figure transport units from said first position to said second position.

4. The toy of claim 1 wherein said figure is placed on an additional component of said toy after said second one of said at least two figure transport units moves to said second position for removal of said figure from said second one of said at least two figure transport units.

5. The toy of claim 1 wherein one of said arm attachment portion of said figure and said figure attachment portions of said arms of said at least two figure transport units is a magnet and the other of said arm attachment portion of said figure and said figure attachment portions of said arms of said at least two figure transport units is a magnetically conductive material.

6. The toy is claim 1 wherein both of said arm attachment portion of said figure and said figure attachment portions of said arms of said at least two figure transport units are magnets.

7. A toy comprising:

a figure having an arm attachment means; and at least two figure transport units, each of said figure transport units having a body and an arm means movable between a first position and a second position with respect to said body, said arm means having a figure attachment means and a figure removal means for removable attachment of said figure thereto, said figure attachment means of said arm means having a first configuration remote from said figure removal means for attachment of said figure to said arm means by attachment of said figure attachment means of said arm means to said arm means attachment means of said figure when said arm means is in said first position, said figure attachment means of said arm means having a second configuration proximate to said figure removal means for removal of said figure from said arm means by separation of said figure attachment means of said arm means from said arm means attachment means of said figure by said figure removal means when said arm means is in said second position whereby said figure is transported from a first one of said at least two figure transport units to a second one of said at least two figure transport units after movement of said arm means of said first one of said at least two figure transport units from said first position to said second position.

8. The toy of claim 7 wherein said arms means of said at least two figure transport units move between said first position and said second position in an arcuate path.

9. The toy of claim 7 wherein at least one of said at least two figure transport units further comprises a spring bias for powering movement of said arm means of said at least one of said at least two figure transport units from said first position to said second position.

10. The toy of claim 7 wherein said figure is placed on an additional component of said toy after said second one of said at least two figure transport units moves to said second position for removal of said figure from said second one of said at least two figure transport units.

11. The toy of claim 7 wherein one of said arm means attachment means of said figure and said figure attachment means of said arms of said at least two figure transport units is a magnet and the other of said arm means attachment means of said figure and said figure attachment means of said arms of said at least two figure transport units is a magnetically conductive material.

12. The toy is claim 7 wherein both of said arm means attachment means of said figure and said figure attachment means of said arms of said at least two figure transport means are magnets.

13. In a toy in which a figure having an arm attachment portion is transported between at least two figure transport units, at least one of said two figure transport units comprising:

a base; and an arm movable between a first position and a second position with respect to said base, said arm having a figure attachment portion and a figure removal portion for removable attachment of said figure thereto, said figure attachment portion of said arm having a first configuration remote from said figure removal portion for attachment of said figure to said arm by attachment of said figure attachment portion of said arm to said arm attachment portion of said figure when said arm is in said fist position, said figure attachment portion of said arm having a second configuration proximate to said figure removal portion for removal of said figure from said arm by separation of said figure attachment portion of said arm from said arm attachment portion of said figure by said figure removal portion when said arm is in said second position whereby said figure is transported from a first one of said at least two figure transport units to a second one of said at least two figure transport units after movement of said arm of said first one of said at least two figure transport units from said first position to said second position.

14. The toy of claim 13 wherein said arms of said at least two figure transport units move between said first position and said second position in an arcuate path.

15. The toy of claim 13 wherein at least one of said at least two figure transport units further comprises a spring bias for powering movement of said arm of said at least one of said at least two figure transport units from said first position to said second position.

16. The toy of claim 13 wherein said figure is placed on an additional component of said toy after said second one of said at least two figure transport units moves to said second position for removal of said figure from said second one of said at least two figure transport units.

17. The toy of claim 13 wherein one of said arm attachment portion of said figure and said figure attachment portions of said arms of said at least two figure transport units is a magnet and the other of said arm attachment portion of said figure and said figure attachment portions of said arms of said at least two figure transport units is a magnetically conductive material.

18. The toy is claim 13 wherein both of said arm attachment portion of said figure and said figure attachment portions of said arms of said at least two figure transport units are magnets.

19. In a toy in which a figure having an arm means attachment means is transported between at least two figure transport units, at least one of said two figure transport units comprising:

a base; and an arm means movable between a first position and a second position with respect to said base, said arm means having a figure attachment means and a figure removal means for removable attachment of said figure thereto, said figure attachment means of said arm means having a first configuration remote from said figure removal means for attachment of said figure to said arm means by attachment of said figure attachment means of said arm means to said arm means attachment means of said figure when said arm means is in said fist position, said figure attachment means of said arm means having a second configuration proximate to said figure removal means for removal of said figure from said arm means by separation of said figure attachment means of said arm means form said arm means attachment means of said figure by said figure removal means when said arm means is in said second position whereby said figure is transported from a first one of said at least two figure transport units to a second one of said at least two figure transport units after movement of said arm means of said first one of said at least two figure transport units from said first position to said second position.

20. The toy of claim 19 wherein said arms of said at least two figure transport units move between said first position and said second position in an arcuate path.

21. The toy of claim 19 wherein at least one of said at least two figure transport units further comprises a spring bias for powering movement of said arm means of said at least one of said at least two figure transport units from said first position to said second position.

22. The toy of claim 19 wherein said figure is placed on an additional component of said toy after said second one of said at least two figure transport units moves to said second position for removal of said figure from said second one of said at least two figure transport units.

23. The toy of claim 19 wherein one of said arm means attachment means of said figure and said figure attachment means of said arms of said at least two figure transport units is a magnet and the other of said arm means attachment means of said figure and said figure attachment means of said arms of said at least two figure transport units is a magnetically conductive material.

24. The toy is claim 19 wherein both of said arm means attachment means of said figure and said figure attachment means of said arms of said at least two figure transport means are magnets.

* * * * *